US007628399B2

(12) United States Patent
Dopfer

(10) Patent No.: US 7,628,399 B2
(45) Date of Patent: Dec. 8, 2009

(54) METHOD AND DEVICE FOR SINGLING SHEET MATERIAL

(75) Inventor: Peter Dopfer, Geltendorf (DE)

(73) Assignee: Giesecke & Devrient GmbH, Munich (DE)

( * ) Notice: Subject to any disclaimer, the term of this patent is extended or adjusted under 35 U.S.C. 154(b) by 182 days.

(21) Appl. No.: 10/484,238

(22) PCT Filed: Jul. 29, 2002

(86) PCT No.: PCT/EP02/08427

§ 371 (c)(1),
(2), (4) Date: Jun. 29, 2004

(87) PCT Pub. No.: WO03/011726

PCT Pub. Date: Feb. 13, 2003

(65) Prior Publication Data

US 2004/0245702 A1 Dec. 9, 2004

(30) Foreign Application Priority Data

Jul. 31, 2001 (DE) ..... 101 37 390

(51) Int. Cl.
*B65H 5/00* (2006.01)

(52) U.S. Cl. ..... 271/265.02; 271/10.02

(58) Field of Classification Search ..... 271/10.02, 271/258.01, 258.03, 258.04, 258.05, 265.03, 271/265.02, 153, 154, 155, 265.01, 263, 271/259; 400/708.1, 624, 634, 708; 270/52.15, 270/52.04, 52.05, 58.03
See application file for complete search history.

(56) References Cited

U.S. PATENT DOCUMENTS

| | | | | |
|---|---|---|---|---|
| 4,200,277 | A * | 4/1980 | Klenk et al. | 271/90 |
| 4,420,747 | A | 12/1983 | Kistner | |
| 4,629,311 | A | 12/1986 | Kaneko et al. | |
| 5,039,077 | A * | 8/1991 | Gunther, Jr. | 270/52.02 |
| 5,067,088 | A * | 11/1991 | Schneiderhan | 700/221 |
| 5,125,635 | A * | 6/1992 | Iwabuchi | 270/56 |
| 5,397,107 | A | 3/1995 | Wolog et al. | |
| 5,575,463 | A * | 11/1996 | Parkander | 270/52.02 |
| 5,890,708 | A * | 4/1999 | Song | 271/10.03 |
| 5,917,930 | A * | 6/1999 | Kayani et al. | 382/135 |
| 6,123,330 | A * | 9/2000 | Schaal | 271/31 |
| 6,152,439 | A * | 11/2000 | Hirayama et al. | 270/52.04 |
| 6,418,279 | B1 * | 7/2002 | Weinberger et al. | 399/2 |
| 6,461,066 | B1 * | 10/2002 | Kelley et al. | 400/624 |
| 6,554,275 | B1 * | 4/2003 | Tranquilla | 271/259 |
| 6,572,096 | B1 * | 6/2003 | Johnson et al. | 271/25 |

(Continued)

FOREIGN PATENT DOCUMENTS

DE 2 318 443 11/1973

(Continued)

*Primary Examiner*—Patrick H Mackey
*Assistant Examiner*—Mark Hageman
(74) *Attorney, Agent, or Firm*—Rothwell, Figg, Ernst & Manbeck, P.C.

(57) ABSTRACT

A method and apparatus for singling sheet material, in particular papers of value such as bank notes, checks, etc., for subsequent processing of single pieces of sheet material. To permit recognition of mix-ups in the singling order, maintenance of the singling order is checked at the place of singling by monitoring whether the next piece of sheet material to be singled is singled.

15 Claims, 2 Drawing Sheets

U.S. PATENT DOCUMENTS

| | | | | |
|---|---|---|---|---|
| 6,572,103 | B1 * | 6/2003 | Tranquilla | 271/265.02 |
| 6,588,740 | B2 * | 7/2003 | Brugger et al. | 271/10.03 |
| 6,662,929 | B1 * | 12/2003 | Neary et al. | 198/460.1 |
| 7,044,463 | B2 * | 5/2006 | Brotherston et al. | 270/52.02 |
| 7,055,817 | B2 * | 6/2006 | Werner et al. | 271/121 |
| 2002/0062749 | A1 | 5/2002 | Kelley et al. | |

FOREIGN PATENT DOCUMENTS

| | | | |
|---|---|---|---|
| DE | 29 30 270 | A1 | 3/1981 |
| DE | 31 33 446 | A1 | 3/1983 |
| DE | 43 18 220 | C2 | 12/1994 |
| WO | WO 00/58192 | A2 | 10/2000 |

* cited by examiner

METHOD AND DEVICE FOR SINGLING SHEET MATERIAL

CROSS-REFERENCE TO RELATED APPLICATION

This application is a §371 of PCT Application Serial No. PCT/EP02/08427, filed Jul. 29, 2002.

BACKGROUND OF THE INVENTION

1. Field of the Invention

The present invention relates to a method and apparatus for singling sheet material, in particular papers of value such as bank notes, checks, etc., for subsequent processing of single pieces of sheet material.

2. Description of the Background Art

Sheet material, e.g. bank notes, are usually processed using bank note processing machines wherein the bank notes are inserted into an input pocket in a stack. The input pocket is connected with a singler that singles the bank notes present in a stack and transfers them singly to a transport system. The transport system then transports the single bank notes e.g. past sensors for e.g. counting, recognizing and checking the state and authenticity of the bank notes. In dependence on the check results the single bank notes can finally be sorted into different output pockets.

Problems in processing can always arise when errors occur in the singling of the bank notes. A well-known error of this kind is the so-called double pick. Instead of a single bank note, two or more bank notes are grasped by the singler and transferred to the transport system. Errors of this kind can be recognized without any great problems by determining the thickness of the singled bank notes. If the determined thickness exceeds a predetermined threshold value, it is recognized that more than one bank note was singled. Greater problems result when the error involves a mix-up of the singling order. In this case the bank note to be singled next is not singled, but a bank note disposed after said note in the stack of bank notes inserted into the input pocket. A mix-up of singling order is problematic within a stack of bank notes in particular in the processing of different groups of bank notes separated from each other by separation or header cards. In this case a mix-up of singling order can lead to bank notes being erroneously attributed to the wrong group of bank notes.

The problem of the present invention is therefore to specify a method and apparatus for singling sheet material, in particular papers of value such as bank notes, checks, etc., for subsequent processing of single pieces of sheet material wherein mix-ups of the singling order can be recognized.

The invention starts out from the consideration that singling order is always maintained when at the place of singling it is checked whether the piece of sheet material to be singled next is singled.

The advantage of the invention is to be seen in particular in that it permits problems to be avoided that result from a mix-up of singling order. Such mix-ups are problematic in particular in the processing of different groups of bank notes by means of separation cards since in this case the single groups of bank notes are accounted for incorrectly.

In a development it is provided that monitoring of the singling order is effected by checking a motion of the next piece of sheet material to be singled.

The advantage of the development is to be seen in particular in that monitoring the motion of the next piece of sheet material to be singled permits an especially simple realization of the monitoring of singling order.

BRIEF DESCRIPTION OF THE DRAWINGS

Further advantages of the present invention can be found in the dependent claims and the following description of embodiments with reference to figures, in which:

DETAILED DESCRIPTION OF THE INVENTION

Figure 1:
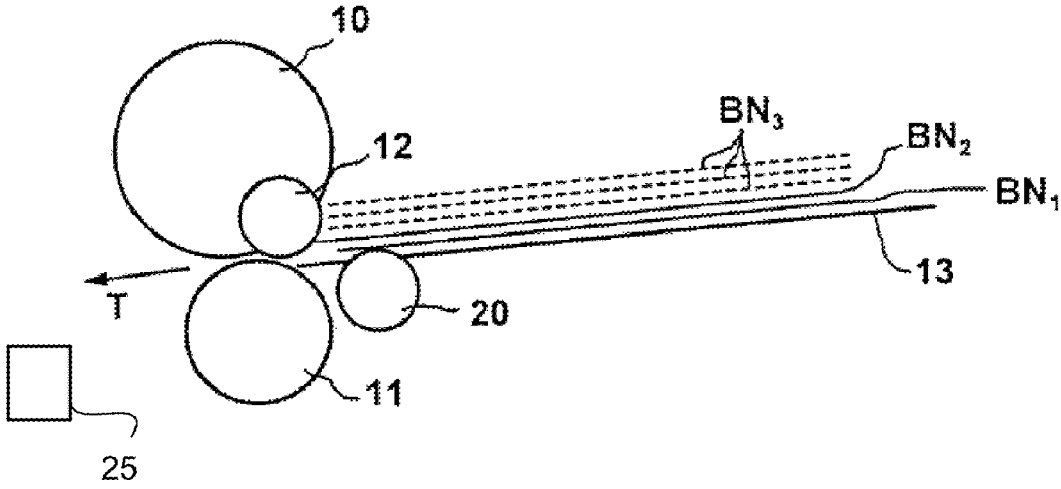
FIG. 1 shows a schematic structure of an inventive apparatus for singling sheet material according to a first embodiment.

FIG. 1 shows a first embodiment of an apparatus for singling sheet material consisting of singler 10 to 13. Singler 10 to 13 works as a so-called friction wheel singler in the shown example and has singling wheels 10 and 11, retaining wheel 12 and input pocket 13 with a support for bank notes $BN_1$ to $BN_3$ to be singled. During singling by singler 10 to 13, bank notes $BN_1$ to be singled are grasped by singling wheels 10 and 11, singled and transferred to a transport system (not shown) of a bank note processing machine in which singler 10 to 13 is integrated. The transport system transports singled bank notes BN in stated direction T to permit further processing, such as testing, counting, sorting, etc. While one bank note $BN_1$ is being grasped and singled, other bank notes $BN_2$, $BN_3$ of the stack of bank notes inserted into input pocket 13 are retained by retaining wheel 12, so that only bank note $BN_1$ to be singled is singled.

In the case shown in FIG. 1, however, there is the danger of following bank note $BN_2$ being singled instead of bank note $BN_1$ to be singled next, and thus the predetermined singling order changed. This danger exists since bank notes BN lie on each other in the stack inserted into input pocket 13 in such a way that the leading edge of following bank note $BN_2$ is located before the leading edge of bank note $BN_1$ to be singled next. Thus there is a high probability in the shown case of following bank note $BN_2$ being grasped and singled by singling wheels 10, 11 instead of bank note $BN_1$ to be singled next.

Such a mix-up of singling order is problematic in particular in cases where different groups of bank notes are being processed. Such different groups of bank notes can be formed for example by deposits from different depositors. For separating the different deposits, so-called separation or header cards are placed between the various deposits or groups of bank notes before the latter are inserted into input pocket 13 as a stack. If such a separation card is present at the place of bank note $BN_2$ in the case shown in FIG. 1, a mix-up of singling order results in the assumption, after faulty singling of the separation card (bank note $BN_2$), that a new group of bank notes or a new deposit is beginning. Bank note $BN_1$ subsequently singled in mixed-up singling order is thus associated with the new group of bank notes or new deposit which is marked by the separation card (bank note $BN_2$). Bank note $BN_1$ is thus not attributed to the previous group of bank notes to which it belongs, but to the following group of bank notes, so that the accounting of the two groups of bank notes is incorrect.

Such accounting errors can be avoided if the mix-up of singling order is recognized, since this permits corresponding measures for correction to be taken. This is done using sensor 20 provided in input pocket 13 or the support of input pocket 13. Sensor 20 detects whether bank note $BN_1$ to be singled next is singled. For this purpose, the embodiment shown in FIG. 1 has mechanical sensor 20 which is formed by a roller with an incremental transducer. The signal of the incremental transducer is monitored as to whether pulses are generated at the time of an expected singling due to rotation of the roller caused by the singling of bank note $BN_1$ to be singled next. If the number of pulses corresponding to the path that bank note $BN_1$ is transported and resulting from the length of bank note $BN_1$ is additionally determined, a statement can be made with a high degree of certainty on whether next bank note $BN_1$ to be singled was singled. If no pulses in the signal of the incremental transducer are observed at the time of singling, however, bank note $BN_1$ to be singled next was not singled. In this case two events can have occurred. The first event can be a gap in singling, i.e. no bank note was grasped and singled by singling wheels 10, 11 at the predetermined singling time. In the second event, another bank note $BN_2$ was singled instead of bank note $BN_1$ to be singled next. The fact that singling took place can be detected for example by means of a light barrier 25 in the transport system. Occurrence of the first event is uncritical. If the second event involving a mix-up of singling order is detected, however, suitable measures for error correction can be taken, e.g. singling stopped to eliminate the mix-up.

Figure 2:
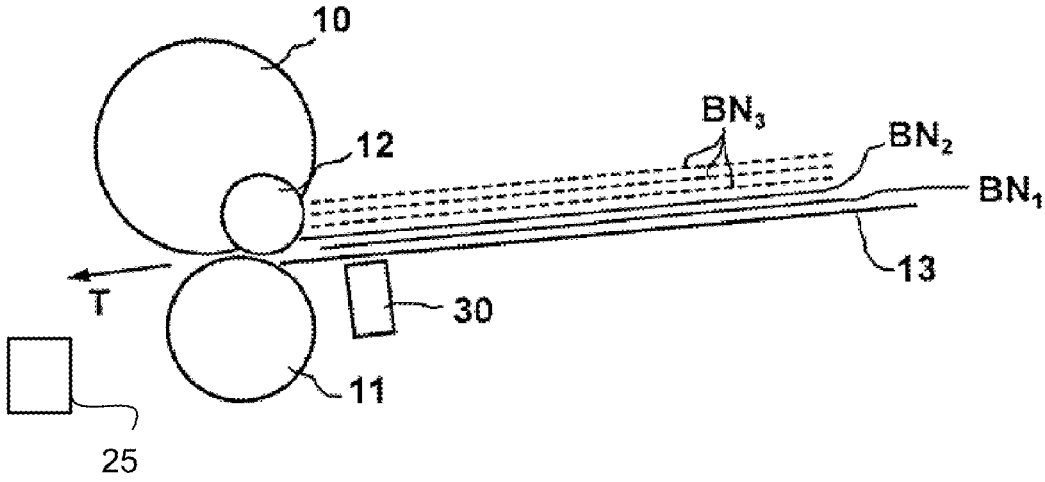
FIG. 2 shows a schematic structure of an inventive apparatus for singling sheet material according to a second embodiment.

FIG. 2 shows a second embodiment of an apparatus for singling sheet material consisting of singler 10 to 13. Except for sensor 20, the second embodiment shown in FIG. 2 corresponds to the first embodiment shown in FIG. 1. The second embodiment according to FIG. 2 instead has sensor 30 that determines contactlessly whether bank note $BN_1$ to be singled next is grasped and singled by singling wheels 10, 11. Sensor 30 can be formed as an optical sensor for example. For detecting whether bank note $BN_1$ to be singled next is singled, optical sensor 30 can be designed for motion detection or optical sensor 30 is used to perform an image evaluation. As described for the first embodiment according to FIG. 1, the evaluation of optical sensor 30 is also effected during the time periods when singling is expected. It is likewise determined at likewise determined at the same time whether bank note $BN_1$ to be singled next is grasped and moved sufficiently far.

Figure 3:
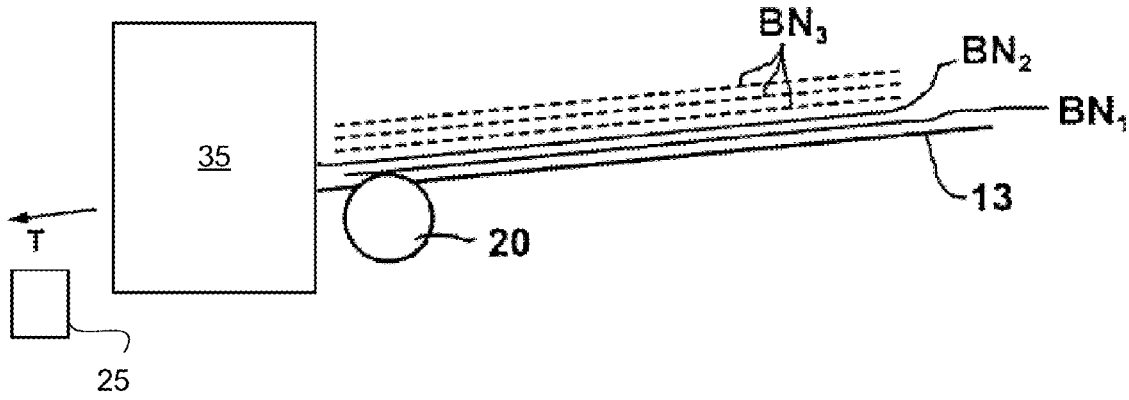
FIG. 3 shows a schematic structure of an inventive apparatus for singling sheet material according to an embodiment of the present invention The figures show only the components essential in connection with the present invention. Similar components of the figures are marked by the same reference signs.

It is obvious that the described inventive apparatuses and methods can not only be used for the friction wheel singlers shown by way of example in the figures. Rather, the described principle is also suitable for singlers having a different structure, e.g. so-called suction air singlers which grasp bank notes to be singled by suction air or vacuum. FIG. 3 depicts the inventive singling apparatus according to an embodiment of the present invention. As shown in FIG. 3, singling wheels 10 and 11 may be replaced with a suction air singler 35 to facilitate singling. As with the apparatus shown in the previous embodiments, the fact that singling took place can be detected by means of light barrier 25, which is downstream of the singler.

Likewise, it is obvious that singling can also be done from above, i.e. the uppermost bank note in the stack singled, instead of singling from below as shown in the figures, i.e. singling of the lowermost bank note in the stack.

Further, it is possible to mount sensor 20, 30 not in input pocket 13 or its support but at a different place in the area of singler 10 to 13 where the described monitoring of next bank note $BN_1$ to be singled is possible.

The invention claimed is:

1. A method for singling sheet material, for subsequent processing of single pieces of sheet material, comprising:

inserting, in a predetermined singling order, sheet material to be singled into an input pocket;

singling, with a singler, the inserted sheet material according to the predetermined singling order;

detecting, with a sensor, at a time of singling, that a first piece of sheet material to be singled in the predetermined singling order has not moved;

determining that a second piece of sheet material was singled instead of said first piece of sheet material; and taking measures for error correction.

2. A method according to claim 1, further comprising checking how far the first piece of sheet material is moved at the time of singling.

3. A method according to claim 1, further comprising checking whether an additional piece of sheet material was also singled at the time of singling.

4. A method according to claim 1, wherein said taking measures for error correction include stopping said singling.

5. An apparatus for singling of sheet material, for subsequent processing of single pieces of sheet material, comprising:

a singler having an input pocket for sheet material to be singled, the sheet material to be singled being inserted into the singler in a predetermined singling order and singled accordingly;

a first sensor, provided in an area of the input pocket, for detecting, at a time of singling, that a first piece of sheet material to be singled in the predetermined singling order has moved;

a second sensor for detecting at the time of singling whether a second piece of sheet material was singled, wherein, the apparatus is configured such that if the first sensor detects that the first piece of sheet material has not moved and the second sensor detects that the second piece of sheet material was singled, then error correction measures are taken.

6. An apparatus according to claim 5, characterized in that the sensor has devices for mechanical detection.

7. An apparatus according to claim 5, characterized in that the sensor has devices for optical detection.

8. An apparatus according to claim 5, characterized in that the apparatus for singling is formed by a friction wheel singler.

9. An apparatus according claim 5, characterized in that the apparatus for singling is formed by a suction air singler.

10. A method for singling bank notes, comprising:

forming a stack of bank notes, having a predetermined singling order, from a plurality of bank note groups, each bank note group including a header card and a plurality of bank notes;

inserting the bank note stack into a singler having an input pocket;

singling the bank note stack according to the predetermined singling order;

detecting, with a sensor, at a time of singling, that a first bank note to be singled in the predetermined singling order has moved;

determining that a second bank note was singled instead of said first bank note; and taking measures for error correction.

11. A method according to claim 10, further comprising determining how far the first bank note is moved at the time of singling.

12. A method according to claim 10, further comprising determining whether an additional bank note was also singled at the time of singling.

13. A method according to claim 10, wherein said taking measures for error correction includes stopping said singling.

14. A method according claim 10, wherein said singling is performed by a friction wheel singler.

15. A method according claim 10, wherein said singling is performed by a suction air singler.

* * * * *